US007156468B2

(12) United States Patent
Neil

(10) Patent No.: US 7,156,468 B2
(45) Date of Patent: Jan. 2, 2007

(54) ADJUSTABLE GROMMET FOR A CHAIR SEAT

(75) Inventor: Gary Neil, Mississauga (CA)

(73) Assignee: Allseating Corporation, Mississauga (CA)

( * ) Notice: Subject to any disclaimer, the term of this patent is extended or adjusted under 35 U.S.C. 154(b) by 0 days.

(21) Appl. No.: 10/873,216

(22) Filed: Jun. 23, 2004

(65) Prior Publication Data

US 2004/0256906 A1 Dec. 23, 2004

(51) Int. Cl.
*A47C 31/00* (2006.01)

(52) U.S. Cl. ..... 297/463.1; 16/2.1

(58) Field of Classification Search ..... 297/463.1, 297/463.2, 440.1, 440.24, 440.23, 440.22, 297/447.4; 248/621, 609; 403/307, 305, 403/220, 223; 16/2.1, 2.4
See application file for complete search history.

(56) References Cited

U.S. PATENT DOCUMENTS 3,052,435 A * 9/1962 Roller ..... 248/569
3,137,887 A * 6/1964 Mannino et al. ..... 16/2.1
3,204,284 A * 9/1965 Merriman ..... 16/2.1
4,205,404 A 6/1980 Levins
4,295,691 A * 10/1981 Rubenthaler ..... 384/297
4,566,735 A * 1/1986 Frobose ..... 297/452.46
4,671,567 A 6/1987 Frobose
4,968,091 A * 11/1990 Mariol ..... 297/3
5,152,582 A * 10/1992 Magnuson ..... 297/440.2
5,688,024 A * 11/1997 Arizpe-Gilmore ..... 297/217.1
5,720,513 A 2/1998 Raukauskas
5,853,059 A 12/1998 Goertzen et al.
6,270,162 B1 * 8/2001 Jeny ..... 297/440.22
6,511,037 B1 * 1/2003 Newman ..... 248/609
6,547,207 B1 * 4/2003 Thompson ..... 248/638

* cited by examiner

*Primary Examiner*—Peter M. Cuomo
*Assistant Examiner*—Joseph Edell
(74) *Attorney, Agent, or Firm*—Miller Thomson LLP

(57) ABSTRACT

An adjustable grommet for a chair including an oval shaped member having a top surface, a bottom surface and a contiguous curved side surface. The adjustable grommet is positioned between the chair seat and the chair legs. The adjustable grommet can flex and compress so that the chair seat is adjustable to the user's desired position.

9 Claims, 5 Drawing Sheets

ADJUSTABLE GROMMET FOR A CHAIR SEAT

FIELD OF THE INVENTION

This invention relates in general to an adjustment device and more particularly to an adjustable grommet for use with a chair seat or base for flexing and repositioning the base of the chair for accommodating different users while maintaining the stability of the chair.

BACKGROUND OF THE INVENTION

Adjustment devices for chairs have been developed to mainly improve the quality of the comfort of the chair. In particular, the seat or base portion of the chair has been the focus of numerous inventions. These inventions have focused on some form of means that may be used for adjusting the contour of the bottom or base of the chair. In general, the means used for adjusting the chair base has been some form of pin, lever or other device. The use of a grommet that is adjustable has not been contemplated as a way of changing the contour of the seat.

Prior art devices have used grommets for a variety of reasons in the chair industry but none have been used as an adjustment device for a chair base. For example, U.S. Pat. Nos. 4,671,567 and 4,566,735 issued on Jun. 9, 1987 and Jan. 28, 1986 respectively to Frobose. These patents relate to an upholstered clean room seat utilizing a co-acting rubber grommet that is installed into an opening of a rigid panel. The grommet has an internal annular bead, which interlocks, using a sealant, with an annular groove of a connector sleeve. The result is an effective self-sealing connection between a breather bag and the interior of the upholstered seat.

Mariol is the owner of U.S. Pat. No. 4,968,091, which issued on Nov. 6, 1990. This patent relates to an article useful as a booster chair and as a step stool. The device includes a series of grommets of an elastomeric material, such as synthetic rubber which are snap-fitted into suitable apertures. The grommets serve as skid resistant feet, which are adapted to engage a horizontal surface in its various orientations.

Goertzen is the owner of U.S. Pat. No. 5,853,059, which issued on Dec. 29, 1998. This patent relates to powered wheelchair with an adjustable center of gravity and independent suspension. The system includes resilient material grommets and rubber bushings positioned at the shock absorber top mounting socket and bottom mounting socket to improve the ride of the wheelchair in motion.

Raukaukas is the owner of U.S. Pat. No. 5,720,513, which issued on Feb. 24, 1998. This patent relates to a vehicle seat with removable toilet, which includes a series of grommets positioned in a series of apertures that receive pins that secure the toilet in place.

Thus an adjustment device for a chair for adjusting the contour of the bottom or base of the chair using an adjustable grommet is desirable.

SUMMARY OF THE INVENTION

An object of one aspect of the present invention is to provide an improved adjusting device for a chair that changes the contour of the base of the chair to accommodate different users.

In accordance with one aspect of the present invention, there is provided an adjustable grommet for use in a chair.

Conveniently, the adjustable grommet includes an oval shaped member having a top surface, a bottom surface and a contiguous curved side surface positioned between the chair seat and the chair legs.

Preferably, at least two grommets are positioned between the front corners of the chair seat and the front legs of the chair. Depending on the weight of the user and his/her position while in the chair, the grommets will compress or flex to allow the chair seat to adjust to the user's desired position of comfort.

Advantages of the present invention are the adjustability of the chair base or bottom to individual users using an adjustable grommet, the ease that the chair may be adjusted without the need for levers, pins or alternative devices.

BRIEF DESCRIPTION OF THE DRAWINGS

A detailed description of the preferred embodiment is provided herein below by way of example only and with reference to the following drawings, in which.

Figure 1:
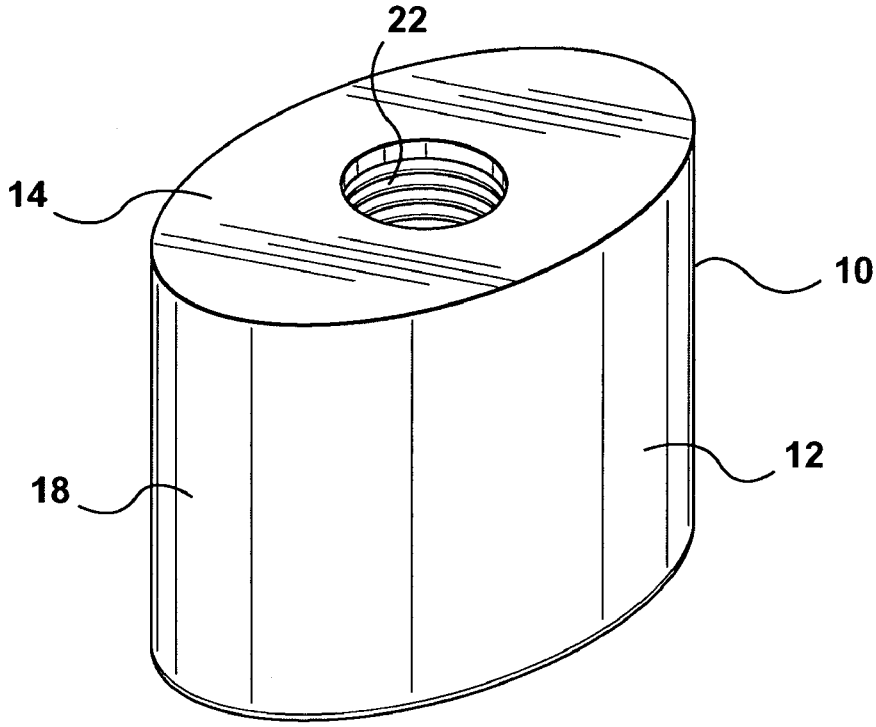
FIG. 1 in a top perspective view, illustrates an adjustable grommet for a chair in accordance with the preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 2:
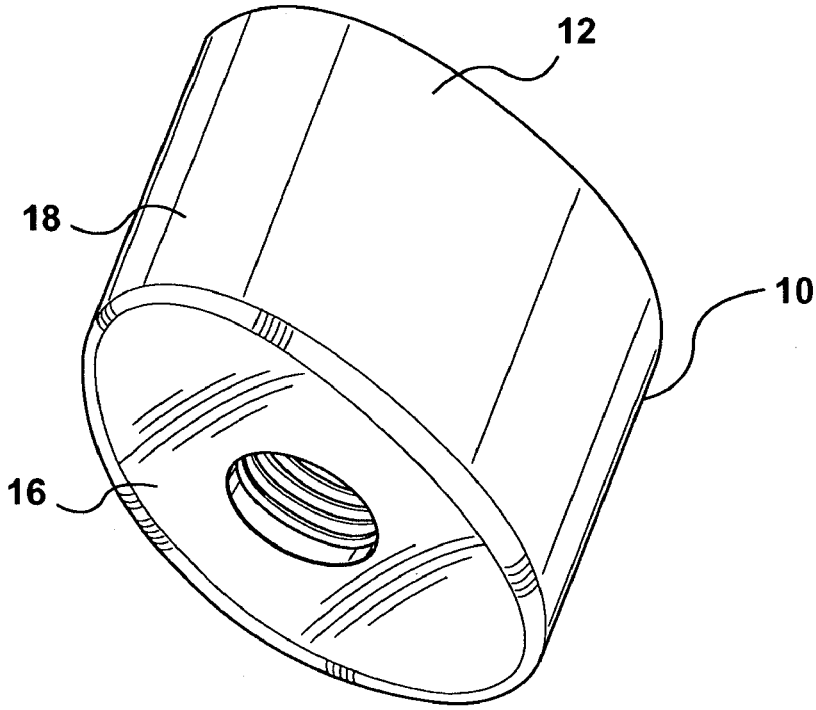
FIG. 2 in a bottom perspective view, illustrates the adjustable grommet of FIG. 1.
Figure 3:
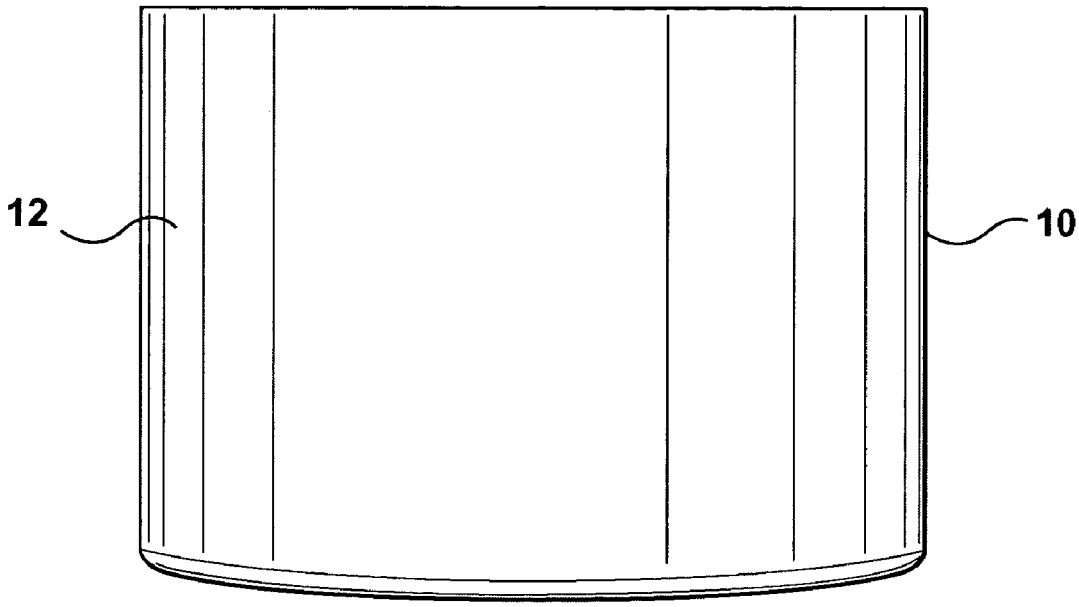
FIG. 3 in a side view, illustrates the adjustable grommet of FIG. 1.
Figure 4:
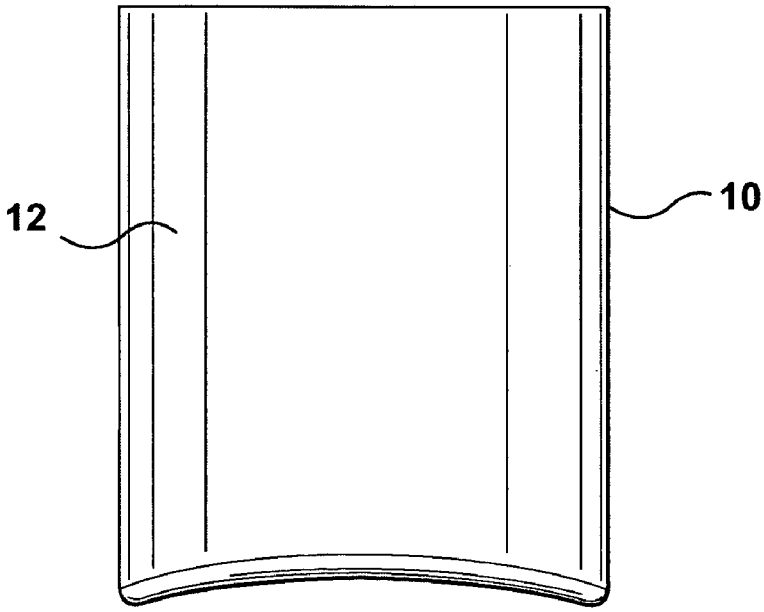
FIG. 4 in an end view, illustrates the adjustable grommet of FIG. 1.
Figure 5:
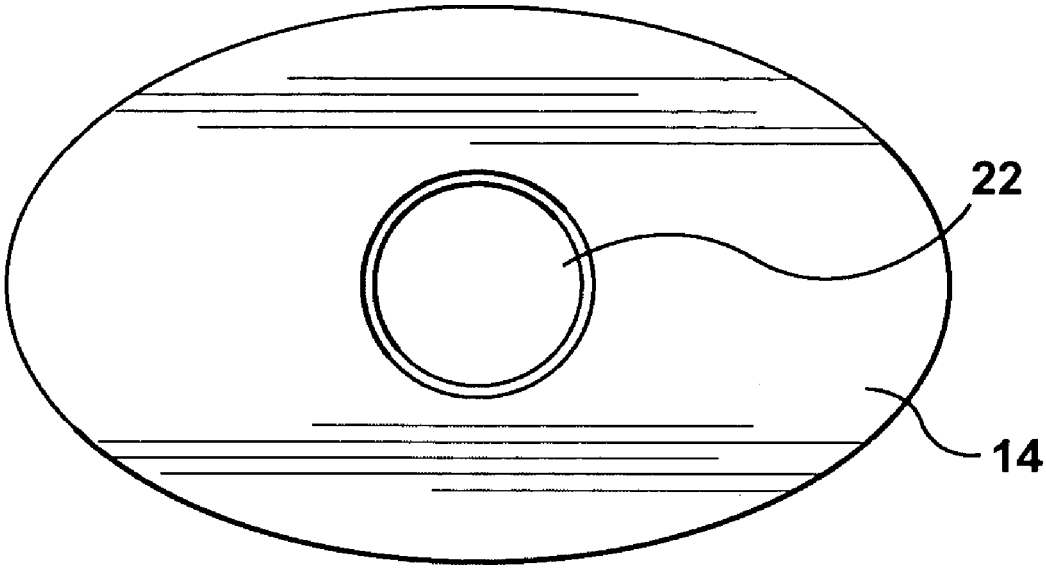
FIG. 5 in a top view, illustrates the adjustable grommet of FIG. 1.
Figure 6:
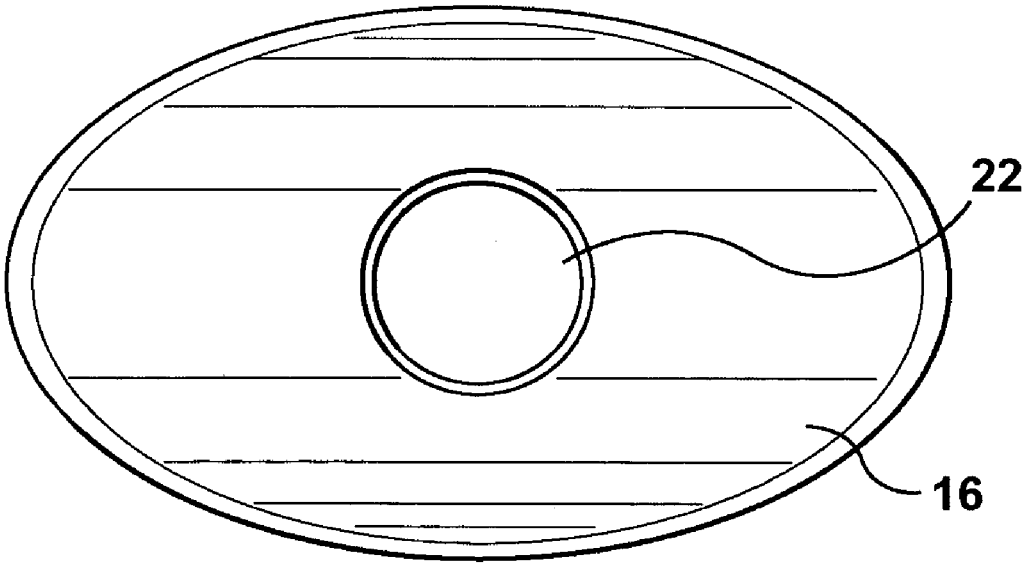
FIG. 6 in a bottom view, illustrates the adjustable grommet of FIG. 1.

Referring to FIGS. 1 and 2, there is illustrated in perspective views, an adjustable grommet 10 for a chair seat 11 in accordance with a preferred embodiment of the present invention. The adjustable grommet 10 includes an oval shaped member 12 having a top surface 14, a bottom surface 16 and a contiguous curved side surface 18 and is positioned between the chair seat 11 and the chair legs 13.

Referring to FIGS. 3–6, the top surface 14 is planar and lies adjacent to the curved side surface 18. The top surface 14 includes an aperture 22 adapted to receive a fastener 24 (not shown) so that the fastener 24 passes through the aperture 22 and attaches to the underside of the chair seat 11.

The purpose of the fastener 24 is to secure the legs of the chair 13 to the seat or base of the chair 11. The aperture 22 is located centrally in the oval member 12 and extends through the oval shaped member 12 to the bottom surface 16 and may be threaded.

The bottom surface 16 is a concave shaped surface and includes the aperture 22 to accommodate the fastener 24. The bottom concave shaped surface 16 allows the grommet 10 to remain positioned on the chair legs 13 without having the grommet 10 actually attached to the chair legs 13. This positioning allows the grommet 10 to freely flex and compress to any desired position. The concave shaped bottom surface 16 allows for the grommet to be positioned on the curved surface of the chair legs 13. Furthermore, the grommet 10 is not directly attached to either the chair seat 11 or the chair legs 13, so as to be able to freely compress and flex to the desired position of the chair seat 11.

Figure 7:
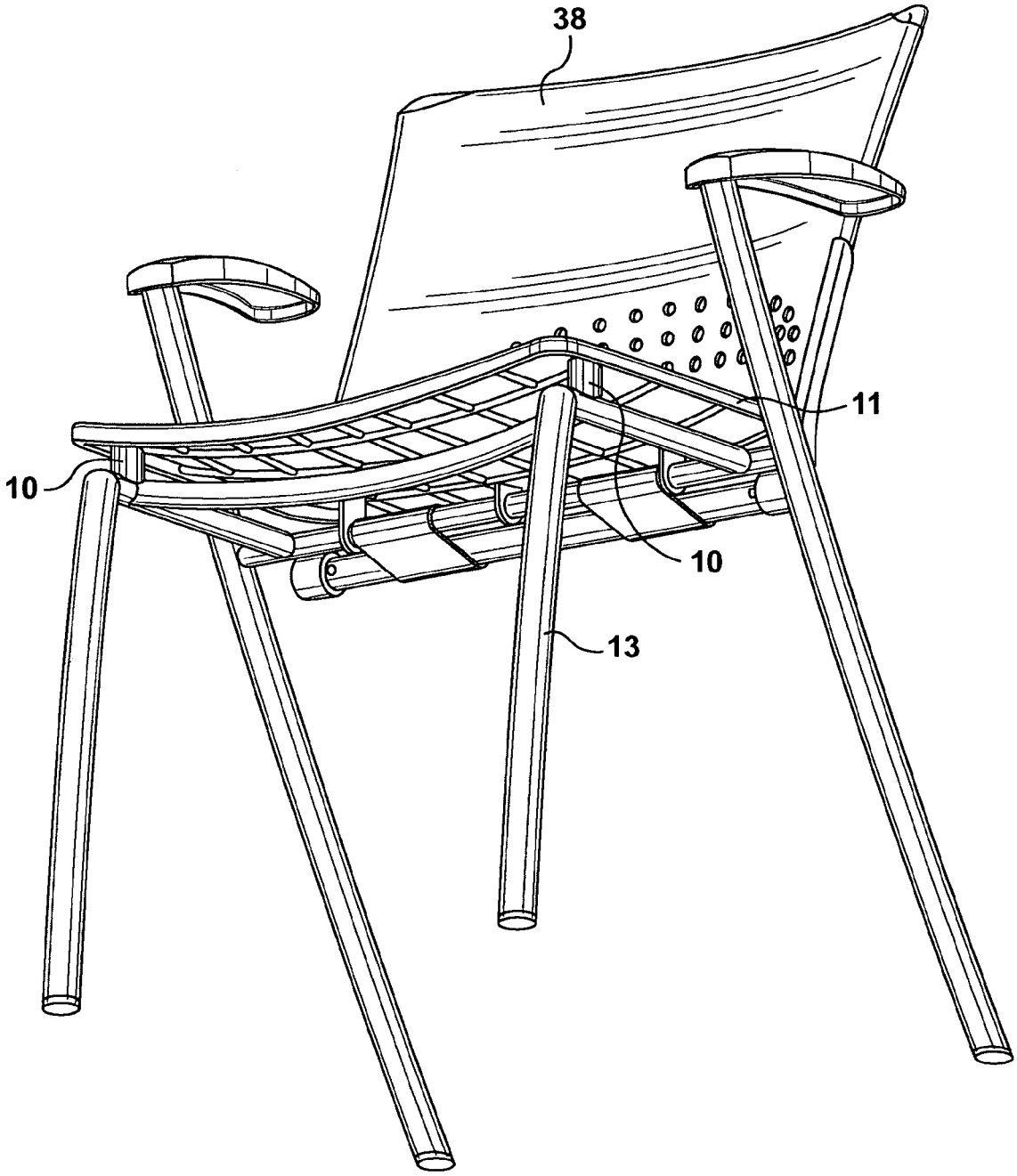
FIG. 7 in a bottom perspective view, illustrates a series of adjustable grommets of FIG. 1 positioned in use with a chair.
Figure 8:
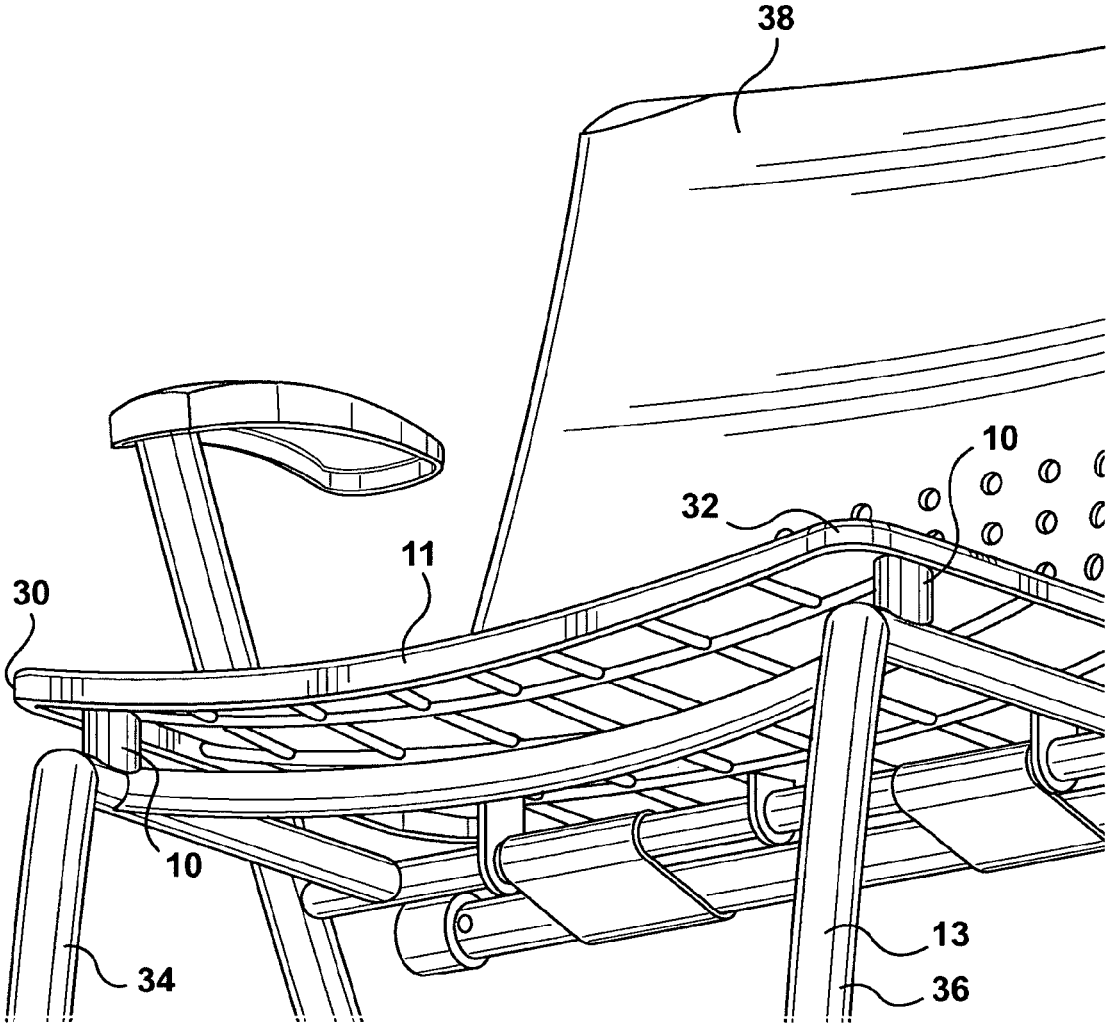
FIG. 8 in an enlarged perspective view, illustrates the series of adjustable grommets of FIG. 7.

Referring to FIGS. 7 and 8, in general, one grommet 10 is placed between each of the front corners, 30 and 32 respectively, of the chair seat 11 and each of the front legs 34 and 36 respectively. The grommet 10 may be made from a wide variety of elastomeric materials that provide sufficient strength to hold the user's weight without breaking down, while providing enough flexion and compression to allow for the adjustment of the chair set 11 to the desired position. More specifically the grommet 10 may be made from rubber, a thermoplastic elastomer with a durometer of 64 Shore A, by way of example, though the durometer of the rubber may change so as to increase or decrease the hardness of the rubber to allow different levels of flexibility or compression. Furthermore the chair seat 11 may be of various shapes and designs to accommodate the user's preference.

In operation, at least two grommets 10 are positioned between the front corners 30 and 32 of the chair seat 11 and the front legs 34 and 36 of the chair 38. The grommets 10 are not attached to either the chair seat 11 or the legs of the chair 13. When the user sits in the chair 38, the weight of the user is transferred through the chair 38 to the grommets 10. Depending on the weight of the user and his/her position while in the chair 38, the grommets 10 will compress or flex to allow the chair seat 11 to adjust to the user's desired position of comfort. It is conceivable that the one grommet 10 at one corner of the chair seat 30 will flex or compress more than the other corner 32 as the weight may not be evenly distributed over the chair seat 11. In this way the grommet 10 is adjustable and allows for the shape chair seat 11 to be changed and conformed to user's desired position.

Other variations and modifications of the invention are possible. All such modifications or variations are believed to be within the sphere and scope of the invention as defined by the claims appended hereto.

I claim:

1. An elastomeric adjustable grommet for attachment between a chair seat having a bottom surface and tubular shaped chair leg members, comprising:

(a) an oval shaped member having a width, a length, a flat top surface, a concave shaped bottom surface, said concave shaped bottom surface running the length and width of the grommet and adapted to cradle and engage said tubular shaped chair leg members, and a contiguous curved side surface, wherein said top surface lies adjacent to said contiguous curved side surface;

(b) a contiguous sloped edge connecting said concave shaped, bottom surface and said curved side surface; and (c) an aperture extending through said oval shaped member from said flat, top surface to said concave shaped bottom surface;

wherein said flat, top surface engages said bottom surface of said chair seat and said length and said width of the concave shaped bottom surface engages said tubular chair leg members so that said elastomeric adjustable grommet is adapted to flex and compress and adapted to adjust said chair seat.

2. An elastomeric adjustable grommet for attachment between a chair seat and chair leg members as claimed in claim 1, wherein said aperture is adapted to receive a fastener that passes through said aperture.

3. An elastomeric adjustable grommet for attachment between a chair seat and chair leg members as claimed in claim 2 wherein said fastener is a screw.

4. An elastomeric adjustable grommet for attachment between a chair seat and chair leg members as claimed in claim 3 wherein said aperture is threaded.

5. An elastomeric adjustable grommet for attachment between a chair seat and chair leg members as claimed in claim 4 wherein said aperture is located centrally through said oval shaped member.

6. An elastomeric adjustable grommet for attachment between a chair seat and chair leg members as claimed in claim 5 wherein said elastomeric adjustable grommet is made from rubber.

7. An elastomeric adjustable grommet for attachment between a chair seat and chair leg members as claimed in claim 6 wherein said elastomeric adjustable grommet is made from thermoplastic elastomer having a durometer of 64 shore A.

8. An elastomeric adjustable grommet for attachment between a chair seat and chair leg members as claimed in claim 7 wherein the durometer of said rubber increases or decreases the hardness of said rubber to allow different levels of flexibility or compression.

9. An elastomeric adjustable grommet for attachment between a chair seat and chair leg members as claimed in claim 2 wherein four grommets are adapted to engage said chair seat and said chair leg members and each of said elastomeric adjustable grommets flex and compress different amount at the same time.

* * * * *